US005298313A

United States Patent [19]

Noland

[11] Patent Number: 5,298,313

[45] Date of Patent: Mar. 29, 1994

[54] ABLATIVE AND INSULATIVE STRUCTURES AND MICROCELLULAR CARBON FIBERS FORMING SAME

[75] Inventor: Robert L. Noland, Glenbrook, Nev.

[73] Assignee: Ketema Inc., Odenton, Md.

[21] Appl. No.: 476,050

[22] Filed: Jan. 31, 1990

[51] Int. Cl.[5] ..... D03D 3/00; B32B 7/00; B32B 9/00; D01C 5/00

[52] U.S. Cl. ..... 428/229; 428/225; 428/246; 428/260; 428/398; 428/400; 428/408; 428/902; 428/903; 428/367; 239/DIG. 19; 264/29.2

[58] Field of Search ..... 428/398, 400, 367, 408, 428/229, 225; 264/29.2; 210/500.23, 500.27; 8/140

[56] References Cited

U.S. PATENT DOCUMENTS

| | | | |
|---|---|---|---|
| 3,174,895 | 3/1965 | Gibson . | |
| 3,422,171 | 1/1969 | Oppenlander . | |
| 3,580,731 | 5/1971 | Milewski et al. . | |
| 3,607,672 | 9/1971 | Schmitt . | |
| 3,745,104 | 7/1973 | Hou . | |
| 3,767,741 | 10/1973 | Toyoguchi . | |
| 3,841,079 | 10/1974 | Ram . | |
| 3,925,524 | 12/1975 | Kimmel . | |
| 4,032,607 | 6/1977 | Schulz . | |
| 4,307,478 | 12/1981 | Ward . | |
| 4,317,809 | 3/1982 | Lewis . | |
| 4,374,114 | 2/1983 | Kim . | |
| 4,402,928 | 9/1983 | Lewis . | |
| 4,699,896 | 10/1987 | Sing . | |
| 4,735,841 | 4/1988 | Sourdet | 428/408 |
| 4,746,470 | 5/1988 | Fujimaki . | |
| 4,753,762 | 6/1988 | Li . | |

FOREIGN PATENT DOCUMENTS

| | | |
|---|---|---|
| 1026723 | 1/1989 | Japan . |
| 64-08488 | 9/1989 | Japan . |

OTHER PUBLICATIONS

Exploratory Experiments in the Conversion of Plasticized Melt Spun Pan-Based Precursors To Carbon Fibers. D. Grove et al., vol. 26, pp. 403–411, 1988.

Evolution of Structure and Properties in Continuous Carbon Fiber Formation. M. Balasubramanian et al., pp. 312–313.

Morphology and Oxidative Stabilization of Acrylic Precursor Fibers. J. Jain et al., pp. 310–311.

High-Temperature Deformations in Conversion of Acrylic Fibers To Carbon Fibers. M. Balasubramanian et al., pp. 497–498.

Morphological Rearrangements in Conversion of Acrylic Fibers To Carbon Fibers: Oxidative Stabilization. M. Jain et al., pp. 517–518.

Oxidative Stabilization of Oriented Acrylic Fibres-Morphological Rearrangements, M. Jain et al., Journal of Materials Science 18 (1983), pp. 179–188.

From Pan-Based Precursor Polymers To Carbon Fibers: Evolution of Structure and Properties, A. Abrihaman, Georgia Institute of Technology, pp. 945–952.

Conversion of Acrylonitrile-Based Precursors To Carbon Fibres (Part 3 Thermooxidative stabilization and continuous, low temperature carbonization). M. Balasubramanian et al., Journal of Materials Science, 22 (1987), pp. 3864–3872.

Conversion of Acrylonitrile-Based Precursors To Carbon Fibres (Part 2 Precursor morphology and thermooxidative stabilization), M. Jain et al., Journal of Materials Science 22 (1987), pp. 301–312.

Conversion of Acrylonitrile-Based Precursors To Carbon Fibres (Part 1 A review of the physical and morphological aspects), M. Jain et al., Journal of Material Science 22 (1987), pp. 278–300.

*Primary Examiner*—George F. Lesmes
*Assistant Examiner*—James D. Withers
*Attorney, Agent, or Firm*—Browdy and Neimark

[57] ABSTRACT

Microcellular carbon filaments having a specific gravity no greater than about 1.4 are formed from PAN foamed filaments by carbonizing. These low density carbon filaments, which may also be hollow, have improved insulation properties compared with conventional PAN precursor carbon fibers and can be used as a replacement to rayon precursor carbon fibers where greater insulation is necessary.

17 Claims, 2 Drawing Sheets

ABLATIVE AND INSULATIVE STRUCTURES AND MICROCELLULAR CARBON FIBERS FORMING SAME

FIELD OF THE INVENTION

The present invention relates to improved ablative and insulative characteristics, and particularly ablative components in solid propellent rocket motor nozzle assemblies, and improved microcellular carbon fibers based on PAN for forming such structures.

BACKGROUND

Viscose rayon was the original precursor material employed in the manufacture of large production quantities of carbon fibers. The carbon fibers formed from rayon precursor fibers were used for many purposes including the reinforcement of composite material used for ablative and insulative components exposed to very high temperatures accompanied by highly erosive gas or airflow conditions, such as in the nozzle assembly of a solid propellent rocket motor or for a nose cone of a re-entry vehicle. Indeed, the early design criteria for these components were based on the use of carbon fibers specifically derived from viscose rayon.

As time went by, the use of rayon as a precursor for carbon fibers was largely supplanted by carbon fibers derived from polyacrylonitrile (PAN) precursor, except in two very important areas which still depend on rayon as a precursor for the required carbon fibers. These are the ablative thermal protection components used for the re-entry nose for the NASA space shuttle, and the solid propellant rocket motor nozzle assemblies both for space launch and DOD tactical weapons systems. Approximately twelve thousand pounds of carbon fibers are used in every NASA space shuttle launch.

In almost every other application a conversion has been made to the PAN precursor carbon fiber. Carbon fibers produced from PAN are not only considerably less expensive than carbon fibers produced from rayon, but they have substantially improved properties and performance characteristics in most regards, such as excellent tensile strength which is needed for most uses of carbon fiber reinforcing material. On the other hand, the conventional PAN precursor carbon fiber has a much higher thermal conductivity, and consequently does not function as a satisfactory thermal insulator and therefore cannot be used as a replacement for rayon based carbon fiber where low thermal conductivity properties are most important.

The thermal conductivity is in reference to the fabricated insulator component which contains the carbon fiber. Rocket motor test firings conducted by U.S. agencies have shown that insulators containing PAN based carbon fibers develop a significantly deeper char layer as compared to insulators using rayon based carbon fibers. Thus, the use of PAN based carbon fibers in fabricated solid propellant rocket motor insulators greatly increases the difficult thermal management problems associated with generated propellant burnt gases exceeding 5,000° F. Also of great importance is the approximate 20% difference in specific gravity between the PAN and rayon based carbon fibers. The use of PAN based fibers in place of the rayon based fibers would result in a substantial increase in weight for a satisfactory functional insulator which is contrary to what is desired. Therefore, NASA is not willing to take the risk of changing to PAN, especially in consideration of the Challenger disaster.

However, the continued use of rayon as a precursor of carbon fibers has other problems. First, the rayon used to produce carbon fibers for this purpose must be of very high purity, and the cost of carbon fibers made from higher purity rayon is at present approximately $50/lb. compared with a cost of PAN precursor carbon fibers of only about $26/lb. Even more importantly, however, is the fact that the production of such high purity rayon fibers causes substantial pollution. In recent years these fibers have been produced at only one factory in Virginia, and in the past few months this factory has finally been closed as a pollution offender, and so there is no longer an approved domestic source for high purity rayon which can be converted into the desired carbon fiber. While NASA has a store of acceptable material based on the rayon fibers to last for some time, eventually either a new rayon source or a replacement material will be needed. Currently there is a "crash" program supported by NASA and DOD to qualify another domestic rayon fiber producer as a source for the carbon fiber precursor. This is only a stop gap measure being used to buy time until a satisfactory replacement for the rayon precursor carbon fiber can be developed.

A number of years ago some tests were conducted with a solid propellent rocket motor using a nozzle assembly in which PAN based carbon fibers had been stretch broken and spun into yarn prior to nozzle fabrication. These tests showed about a 30% reduction in thermal conductivity along the lengths of the fiber compared with conventional PAN-based carbon fibers, but no change across the width or diameter of the fiber yarn. The added costs were substantial. It was decided that the improvement provided by this technique was insufficient bearing in mind the added costs which were unacceptable, and the project was abandoned.

The patent literature (see U.S. Pat. Nos. 3,841,079 and 3,925,524) show that Celanese Corporation has experimented with the post-treatment of PAN fibers to produce what is referred to as a "microporous" carbon filament. As explained in Kimmel et al U.S. Pat. No. 3,925,524, the post-treatment of the dry spun PAN filament involves contacting the filament with water. It is well known that PAN absorbs water and indeed it is even known according to the literature that water acts as a blowing agent for PAN, and steps are invariably taken to avoid the presence of water in the PAN spinning solution. For example, the BP Chemicals International Technical Bulletin on their "Barex 210" PAN Resin (Brochure B210-05), copy attached and made a part hereof, states that the resin should be pre-dried before extrusion. This brochure moreover states:

Resin Handling-Drying

As with most nitrile copolymers, Barex 210 resin is hydroscopic and will absorb up to 0.3% moisture in an 8 hour period in hot, humid conditions. If processed at this moisture levels, bubbles will appear in the extruded web.

Barex 210 resin is shipped predried . . . . However, some drying is required for regrind. Information on driers, temperatures, residence time, etc., are contained in the bulletin entitled "Drying Characteristics of Barex 210 Resin". Conveying equipment using ambient air is normally used for transferring from the drier to the extruder hopper. However, long conveying runs with ambient air should be avoided to keep the moisture level of resin low.

In their brochure B210-04 entitled "Drying Characteristics", copy attached and made a part hereof, BP Chemicals International states:

Barex 210 resin processes much better when care is taken to keep it dry, as is the case with most resins. If proper attention is not given to maintaining a low moisture level, a "shark skin" surface or low melt viscosity and melt strength can result. A "sticky" condition can also occur, and bubbles or foaming will result in the most severe cases.

Returning now to the work of Celanese Corporation, a review of the '524 and '079 patents does not suggest any deviation from the accepted practice in the art that the resin must be kept dry during formation of the filaments from PAN. The post treatment operations of Celanese as set forth in the Kimmel et al '524 and the Ram et al '079 patents is apparently capable of reducing the specific gravity only very slightly. Thus, according to the '524 patent (column 10, lines 28 and 68), it was possible to reduce the specific gravity to about 1.63–1.65, the typical PAN based carbon fibers having a specific gravity of about 1.7–1.9. According to the Ram et al U.S. patent '079 (see column 12, line 41), the specific gravity was reduced to only 1.75. The resultant carbon fibers retain good strength properties.

The manufacture of porous and/or cellular polymer filaments of various types, such as for textile uses, is of course well known. For example, the patents of Li et al U.S. Pat. Nos. 4,753,762 and Oppenlander 3,422,171 both show methods for producing foamed polymer filaments. Thus Oppenlander '171 discloses the manufacture of fine denier (5–18 mils), foamed and oriented polypropylene monofilaments. Li et al show the formation of closed-cell foamed fibers formed of siloxane polymers, polyesters, polyamides, etc. Microcellular paintbrush bristles of synthetic polymers have recently also been disclosed to the public. Insofar as is known, however, the manufacture of carbon fibers from such foamed filaments has never been contemplated or seriously considered, perhaps because for most uses carbon fibers must have good tensile strength, whereas it is known that foamed plastic has a markedly reduced tensile strength compared to non-foamed plastic.

Lastly, hollow fibers are also known. For example, hollow paintbrush bristles are known from the patent to Ward et al U.S. Pat. No. 4,307,478. Hollow synthetic fibers for other purposes are also known, e.g. Dupont has on the market a hollow filament for insulation purposes sold under the trademark "Hollow-Fil". Again, insofar as is known, it has never been contemplated to convert hollow synthetic filaments of any kind to carbon filaments.

SUMMARY OF THE INVENTION

It is, accordingly, an object of the present invention to overcome the deficiencies of the prior art, such as those indicated above.

It is another object of the present invention to provide carbon filaments from PAN and related synthetic plastics which carbon filaments have improved insulation properties.

It is a further object of the present invention to provide microcellular closed cell carbon filaments having a specific gravity on the order of about 1.4 starting with microcellular PAN type filaments.

It is still another object of the present invention to provide carbon filaments which are both hollow and cellular, formed from PAN type filaments which are hollow and microcellular.

It is still a further object of the present invention to provide woven carbon fiber fabrics intended for insulation purposes, which carbon fibers are microcellular and have a specific gravity of at most about 1.4.

It is yet a further object of the present invention to provide insulative rocket nozzle parts from microcellular carbon fibers derived from PAN type resins, which parts are substantially equal to or better in ablative and/or insulating properties than otherwise similar parts made from carbon fiber derived from rayon.

These and other objects of the present invention will be more apparent from the following detailed description. In brief, however, the present invention involves the use of microcellular monofilaments of PAN for the manufacture of carbon fiber as a replacement for the carbon fiber presently made from rayon and used in rocket nozzles as an insulator. The fibers so produced have excellent insulative properties, same being highly microcellular so as to have a specific gravity of at most about 1.5 and preferably at most about 1.4. These fibers may also be produced with a hollow core which further reduces their specific gravity and increases their insulative properties.

Additional aspects of the invention will become more apparent from the following detailed description, taken in conjunction with the drawing, wherein:

DETAILED DESCRIPTION OF EMBODIMENTS

Figure 1:
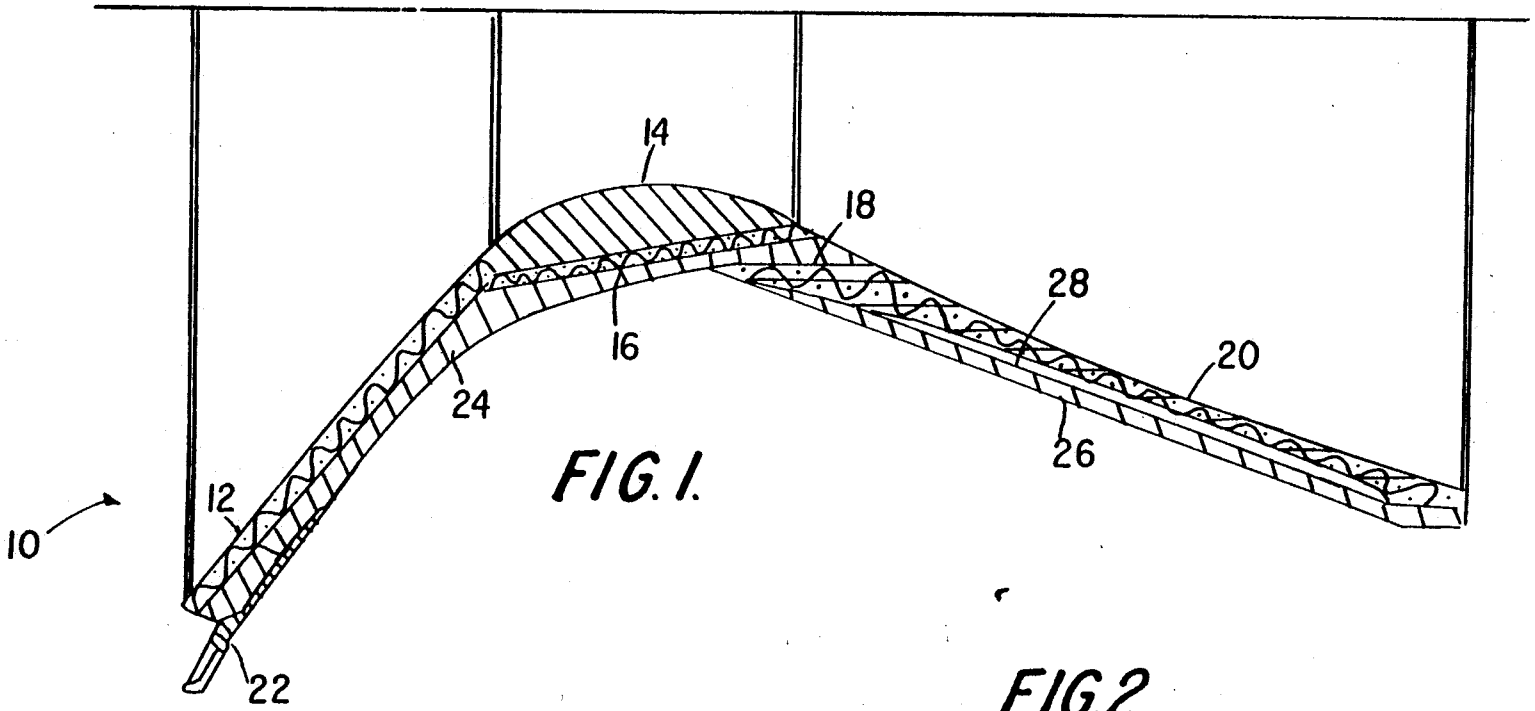
FIG. 1 shows half of the inside, partly in cross-section, of a typical rocket nozzle, embodying ablative and insulative parts constructed using the microcellular fibers of the present invention.

FIG. 1 illustrates a typical rocket nozzle 10 having a convergent cone portion 12, a throat portion 14, a throat back-up 16, an interleaved transition area 18, an exit cone 20, a steel attach ring 22, a primary support structure 24 of glass/phenolic resin or metal, and an exit cone insulation back-up structure 26 of glass/phenolic resin or metal, there being an air gap 28 between the back-up 26 and the exit cone 20. In accordance with the present invention, the convergent cone 12, the throat back-up 16 and the exit cone 20 are formed of a composite of resin, e.g. phenolic resin, impregnated carbon fiber fabric according to the present invention, the carbon fibers being based on PAN precursor and having a microcellular structure as shown in FIGS. 2 and/or 3, so as to provide a specific gravity no greater than 1.5, preferably no greater than about 1.4.

Figure 2:
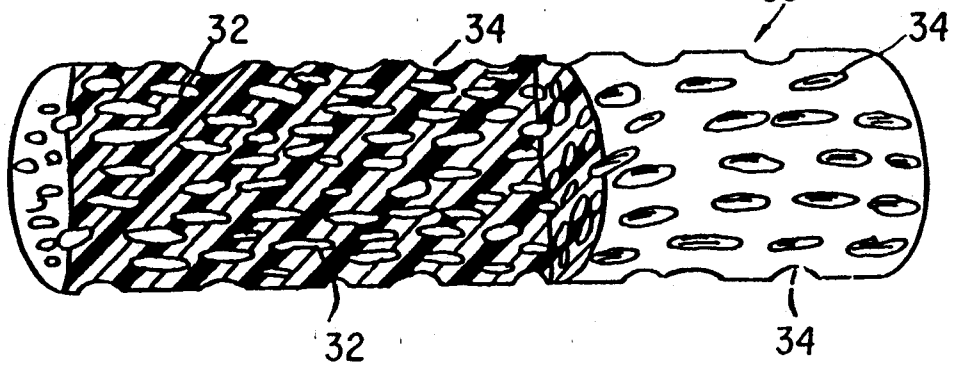
FIG. 2 is a schematic illustration of both a PAN microcellular precursor filament and the microcellular closed cell carbon filament made therefrom, on a greatly enlarged scale.
Figure 3:
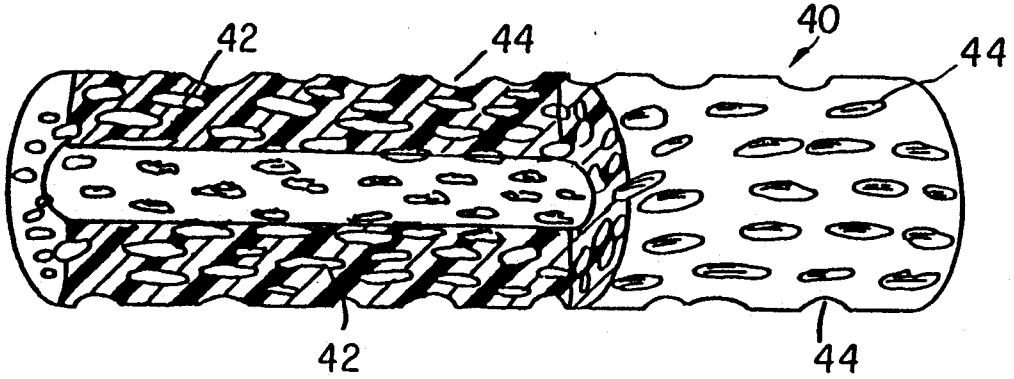
FIG. 3 is a schematic, greatly enlarged view similar to that of FIG. 2 of an alternate embodiment wherein the filament is both hollow and microcellular.

FIGS. 2 and 3 provide schematic representations of two embodiments of PAN precursor fibers and the resultant carbon fibers formed therefrom, in accordance with the present invention. The fiber or filament 30 of FIG. 2 is provided with generally elongated internal cells 32. In addition, partial cells 34 form on the exterior surface so as to provide a pock-marked surface, i.e. a series of depressions. After weaving of the resultant carbon filaments into fabric and impregnation of the fabric with a suitable resin, such as phenolic resin, to form any of the parts 12, 16 or 20 as illustrated in FIG. 1, it is found that exceptional bonding occurs between the resin and the fibers 30 because of the depressions 34 provided in the surface of the fibers. Improved insulation also occurs because of the internal cells 32.

The filament 40 of FIG. 3 is similar to the filament 30 of FIG. 2, having internal cells 42 and external depressions 44, but differs in that the microcellular filament 40 is hollow, same having a bore extending axially therethrough. Because of the hollow bore extending therethrough, the specific gravity of the fiber 40 is quite low, same being on the order of less than 1.35, preferably about 1.0–1.2, and the insulating ability being even greater than that of the microcellular carbon fiber 30 of FIG. 2. In both cases the filaments 30 and 40 desirably have a fiber diameter on the order of about 6–15 microns, as is conventional.

It will be understood that exterior cross-sections other than circular can be formed, e.g. tri- or tetra-lobal. Also, more than one longitudinal bore can be provided, e.g. the fibers can be tri- or tetra-ocular.

Figure 4:
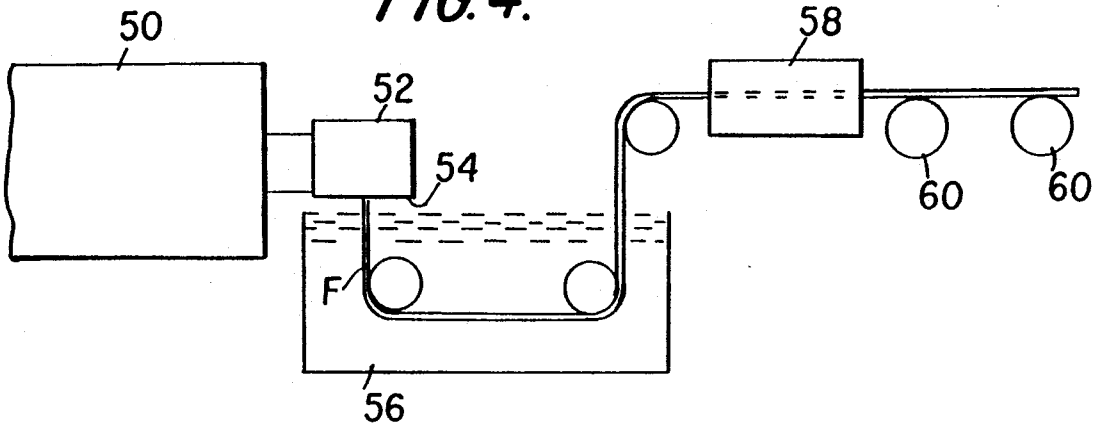
FIG. 4 is a schematic view showing processing in the manufacture of microcellular carbon fibers based on PAN precursor.

FIG. 4 schematically shows how the microcellular carbon fibers 30 and 40 according to the present invention are manufactured, it being understood that such a manufacturing process embodies a combination of previously known procedures.

The PAN resin together with a suitable blowing agent and, if desired, a solvent or plasticizer to lower its melting point, are mixed such as in a screw extruder 50 and then forced through a monofilament or multifilament die 52 at a temperature sufficiently high to release the blowing agent in gaseous form and at least to the softening temperature of the PAN resin mixture. The resultant foamed PAN monofilament or multifilament tow F is then passed through an airgap 54 and then rapidly into an air quench or a quench bath 56 of suitable liquid such as glycerin maintained at a temperature sufficiently low, e.g. between about 10° and 80° C., to effect rapid cooling and solidification of the monofilament or multifilament tow F.

While melt spinning is illustrated, the microcellular PAN filaments can also be similarly prepared using wet spinning or dry spinning techniques, so long as proper selection is made of a foaming agent which is compatible and blendable with the PAN composition in the extruder, and which will foam at the spinning temperature when the filaments leave the die; or blowing can be effected by gas, e.g. $N_2$ or $CO_2$, injection. Thus, regardless of the type of spinning used, if a blowing agent other than injected gas is used, the temperature and pressure relationship must be such that upon extrusion, i.e. spinning, the blowing agent will release gas to effect the necessary blowing.

Suitable blowing agents may be selected from those well known in the art, and which are compatible with PAN. In this regard, attention is invited to the aforementioned Li et al and Oppenlander U.S. patents, the contents of which are hereby incorporated by reference. Other blowing agents are also known. Thus, one suitable composition for melt spinning through a 0.11 mm die orifice at 205° C. into a quench tank at 30° C. is a mixture of 99.75% Barex 210 PAN and 0.25% Hoechst Hostatron P9947 blowing agent.

Returning to FIG. 4, after passage through the quench bath 56 the monofilament or multifilament tow F can be passed through a heating chamber 58 after which the monofilament or multifilament tow can be stretched by drawing by a pair of stretching rolls 60. The heating chamber 58 may be eliminated, and instead the stretching may be carried out in a heated bath, e.g. glycerin at 80° C., as disclosed in the Ram et al U.S. Pat. No. 3,841,079, or orientation may be carried out in water at 60° C. Further processing maybe carried out consistent with the disclosure of U.S. Pat. No. 3,841,079, the contents of which are incorporated by reference. Thus, the filaments may be subject to one or more wash steps and subjected to further stretching such as in another glycerin stretch bath and/or stretching can be effected by passage over a heated draw shoe provided at a constant temperature of 145° C.

The filaments can either be collected for later conversion to microcellular carbon fibers, or the carbonizing process can be in-line with the PAN filament formation, as illustrated. The former is preferred. Regardless, and also consistent with the disclosure of U.S. patent '079 for making carbon filaments and as known elsewhere in the art, the PAN filaments are subjected to a thermal pretreatment such as by passing same through an oven provided with an atmosphere at 195° C. for about 240 seconds while maintaining longitudinal tension so that shrinkage takes place.

Finally, the continuous length of thermally pretreated PAN fibrous material is next passed through a carbonizing oven, e.g. for about 180 minutes through a multiple roll oven provided with an air atmosphere at 265° C., wherein the PAN fibrous material is thermally stabilized and is rendered black and non-burning when subjected to an ordinary match flame. If desired, a further improvement can be achieved as disclosed by U.S. patent '079 by passage of the carbonized filaments through an induction furnace containing an inert gaseous atmosphere.

Other details of processing, including the nature of the PAN material itself, the spinning process, the treatment of the extruded PAN filaments, and the carbonizing process, including various parameters, can be determined from the aforementioned Ram et al U.S. patent '079 as well as from the Kimmel et al U.S. Pat. No. 3,925,524, also incorporated by reference.

The resultant carbon fibers 30 and/or 40 as illustrated in FIGS. 2 and 3, having a microcellular structure and a specific gravity no greater than about 1.5 and preferably 1.4 or less, are then woven into carbon fiber cloth using conventional weaving equipment known for this purpose. The resultant carbon fabric is then used in the conventional way with the usual or improved impregnating resins, such as phenolic resin, to make the parts described above in relation to FIG. 1. As indicated above, the parts are equivalent to those produced from carbon fiber derived from high purity rayon and are superior to conventional PAN precursor carbon fiber in insulation properties. Because of their irregular surfaces provided by the depressions 44, 34, the carbon fibers 40, 30 adhere to the impregnating resin in a superior fashion compared to conventional PAN precursor carbon fibers.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An improved carbon fiber formed from a polyacrylonitrile polymer or co-polymer having a microcellular closed cell structure and a specific gravity no greater than about 1.5.

2. A carbon fiber according to claim 1 having a specific gravity no greater than about 1.4.

3. A carbon fiber according to claim 1 having a hollow bore extending therethrough.

4. A carbon fiber according to claim 3 having a specific gravity no greater than about 1.35.

5. A carbon fiber according to claim 4 having a specific gravity no greater than about 1.0–1.2.

6. A carbon fiber according to claim 1 having a diameter on the order of about 8 microns.

7. A carbon fiber according to claim 1 having a pock marked outer surface.

8. A fabric formed of woven carbon fibers, at least some of said carbon fibers each having a microcellular closed cell structure and a specific gravity no greater than about 1.5.

9. A woven fabric according to claim 8, wherein each said fiber has a hollow bore extending therethrough.

10. A woven fabric according to claim 9, wherein each said fiber has a specific gravity no greater than about 1.35.

11. A woven fabric according to claim 8, wherein each said fiber has a diameter on the order of about 8 microns.

12. A woven fabric according to claim 8, wherein each said fiber has a pock marked outer surface.

13. In a rocket nozzle having one or more ablative and insulative portions formed of resin reinforced carbon fabric, the improvement wherein said carbon fabric is woven from microcellular carbon fibers having a microcellular closed cell structure and a specific gravity no greater than about 1.5.

14. A rocket nozzle according to claim 13 wherein at least some of said carbon fibers have a hollow bore extending therethrough.

15. A rocket nozzle according to claim 13 wherein each said hollow carbon fiber has a specific gravity no greater than about 1.35.

16. A rocket nozzle according to claim 13 wherein each said carbon fiber has a diameter on the order of about 8 microns.

17. A rocket nozzle according to claim 13 wherein each said carbon fiber has a pock marked outer surface.

* * * * *

UNITED STATES PATENT AND TRADEMARK OFFICE

CERTIFICATE OF CORRECTION

PATENT NO. : 5,298,313

DATED : March 29, 1994

INVENTOR(S) : Robert L. NOLAND
Timothy D. O'BRIEN

It is certified that error appears in the above-indentified patent and that said Letters Patent is hereby corrected as shown below:

On the title page, item
--[75] Amended Robert L. NOLAND, Glenbrook, Nev.
Timothy D. O'BRIEN, Croften, MD.--

Signed and Sealed this

Sixth Day of September, 1994

*Attest:*

*Attesting Officer*

BRUCE LEHMAN

*Commissioner of Patents and Trademarks*